US007611380B2

(12) United States Patent
Yuan

(10) Patent No.: US 7,611,380 B2
(45) Date of Patent: Nov. 3, 2009

(54) STACKED ELECTRICAL CONNECTOR ASSEMBLY

(75) Inventor: Wei Yuan, ShenZhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 11 days.

(21) Appl. No.: 12/012,638

(22) Filed: Feb. 4, 2008

(65) Prior Publication Data

US 2008/0188135 A1 Aug. 7, 2008

(30) Foreign Application Priority Data

Feb. 2, 2007 (CN) ..... 2007 2 0034227

(51) Int. Cl.
*H01R 13/66* (2006.01)
*H01R 13/648* (2006.01)

(52) U.S. Cl. ..... 439/541.5; 439/607

(58) Field of Classification Search ..... 439/607, 439/541.5, 540.1
See application file for complete search history.

(56) References Cited

U.S. PATENT DOCUMENTS 5,044,984 A * 9/1991 Mosser et al. ..... 439/541.5
5,167,531 A * 12/1992 Broschard et al. ..... 439/541.5
6,099,351 A * 8/2000 Wu ..... 439/607
6,213,813 B1 * 4/2001 Huang ..... 439/607
6,238,244 B1 * 5/2001 Yang ..... 439/607
6,383,024 B1 * 5/2002 Wang et al. ..... 439/607
6,419,529 B1 * 7/2002 Shi et al. ..... 439/607
6,540,563 B1 4/2003 Hu et al.
7,270,570 B1 * 9/2007 Hamner et al. ..... 439/541.5

* cited by examiner

*Primary Examiner*—Briggitte R Hammond
(74) *Attorney, Agent, or Firm*—Wei Te Chung; Andrew C. Cheng; Ming Chieh Chang

(57) ABSTRACT

A stacked electrical connector assembly comprises a first electrical connector and a second electrical connector stacked with the first electrical connector. The first electrical connector comprises a first metal shell, a first insulative housing shielded in the first metal shell and a plurality of first terminals received in the first insulative housing. The second electrical connector comprises a second metal shell, a second insulative housing shielded in the second metal shell and a plurality of second terminals received in the second insulative housing. The first metal shell defines at least a retaining portion, the second metal shell and second insulative housing respectively defines at least a retaining hole and at least a locking hole corresponding to the retaining hole, said retaining portion locks with the retaining hole and the locking hole.

19 Claims, 4 Drawing Sheets

STACKED ELECTRICAL CONNECTOR ASSEMBLY

BACKGROUND OF THE INVENTION

1. Field of the Invention

The present invention relates to a stacked electrical connector assembly, and more particularly to a stacked electrical connector assembly mounted on a printed circuit board (PCB) to mate with corresponding plugs.

2. Description of the Related Art

A computer is required to provide connectors mounted on a PCB as input/output ports to mate with corresponding connectors of peripheral devices for signal transmission therebetween. In order to sufficiently utilize limited area of the PCB, The stacked electrical connector assembly are usually arranged in a stacked manner. U.S. Pat. No. 6,540,563 B1 discloses such a stacked electrical connector assembly comprising an insulative housing, a pair of upper and lower connectors vertically and integrally stacked in the insulative housing, a spacer connected to the insulative housing, and a pair of metal shells cooperating with the integrally insulative housing. The connector is so high relative to the mounting surface that The stacked electrical connector assembly is space-consuming and easy to incline when the corresponding connectors are inserted into or pulled out therefrom. In addition, this integral connector is so rigid to adapt for multi-condition, such as some time a single connector just be required. Furthermore, when one of the stacked connector is broken, it had to change the total stacked connector. The cost increases accordingly.

Hence, an improved stacked electrical connector assembly is desired to overcome the disadvantages of the prior art.

BRIEF SUMMARY OF THE INVENTION

Therefore, a main object of the present invention is to provide a stacked electrical connector with improved structure.

To fulfill the above-mentioned object, a stacked electrical connector assembly comprises a first electrical connector and a second electrical connector stacked with the first electrical connector. The first electrical connector comprises a first metal shell, a first insulative housing shielded in the first metal shell and a plurality of first terminals received in the first insulative housing. The second electrical connector comprises a second metal shell, a second insulative housing shielded in the second metal shell and a plurality of second terminals received in the second insulative housing. The first metal shell defines at least a retaining portion, the second metal shell and second insulative housing respectively defines at least a retaining hole and at least a locking hole corresponding to the retaining hole, said retaining portion locks with the retaining hole and the locking hole.

Other objects, advantages and novel features of the invention will become more apparent from the following detailed description when taken in conjunction with the accompanying drawings.

BRIEF DESCRIPTION OF THE DRAWINGS

The foregoing summary, as well as the following detailed description of the embodiments of the present invention, will be better understood when read in conjunction with the appended drawings. For the purpose of illustrating the invention, there are shown in the drawings embodiments which are presently preferred. As should be understood, however, the invention is not limited to the precise arrangements and instrumentalities shown. In the drawings.

DETAILED DESCRIPTION OF THE PREFERRED EMBODIMENT

Reference will now be made in detail to the preferred embodiment of the present invention.

Figure 1:
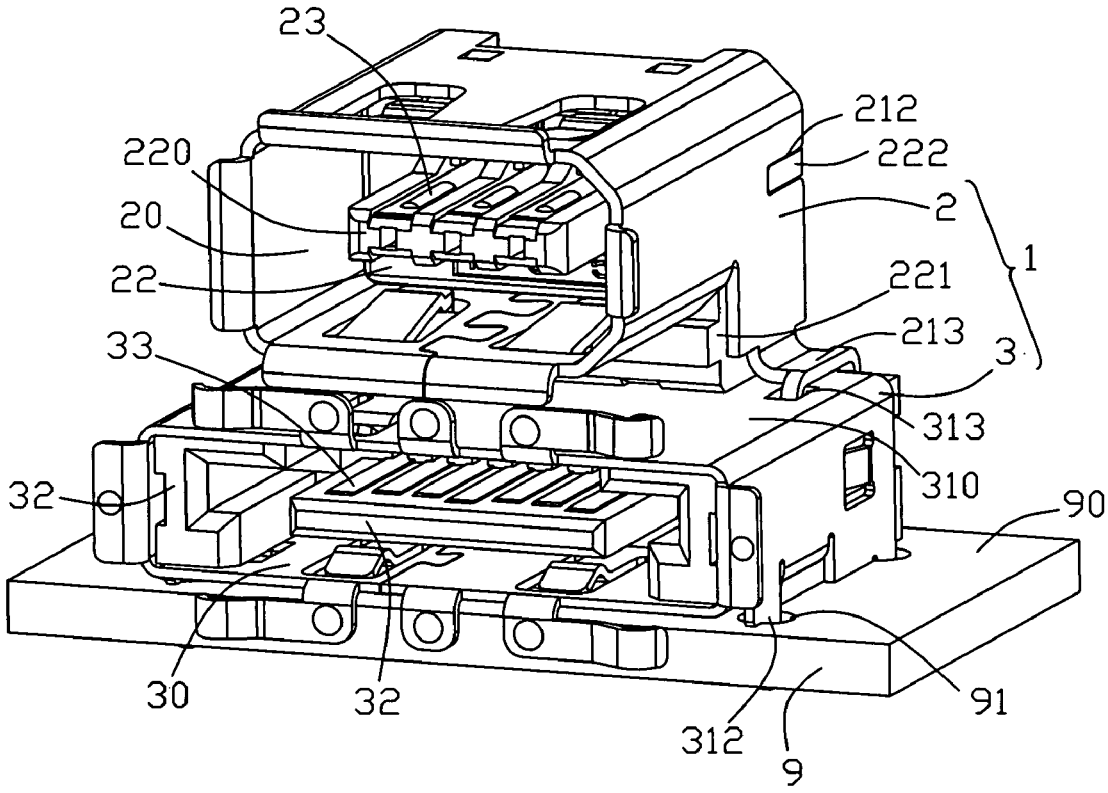
FIG. 1 is an assembled, perspective view of a stacked electrical connector assembly according to the present invention mounted on a printed circuit board.
Figure 2:
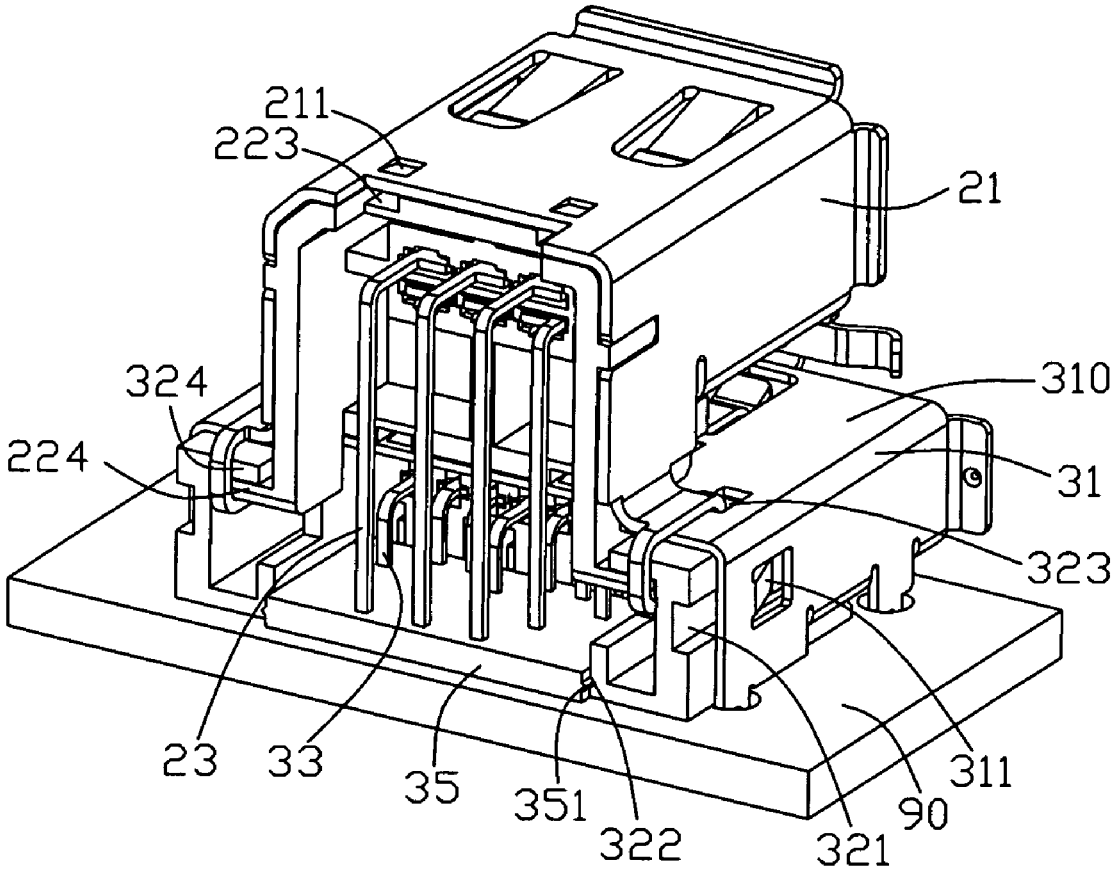
FIG. 2 is a view similar to FIG. 1, but viewed from another aspect.
Figure 3:
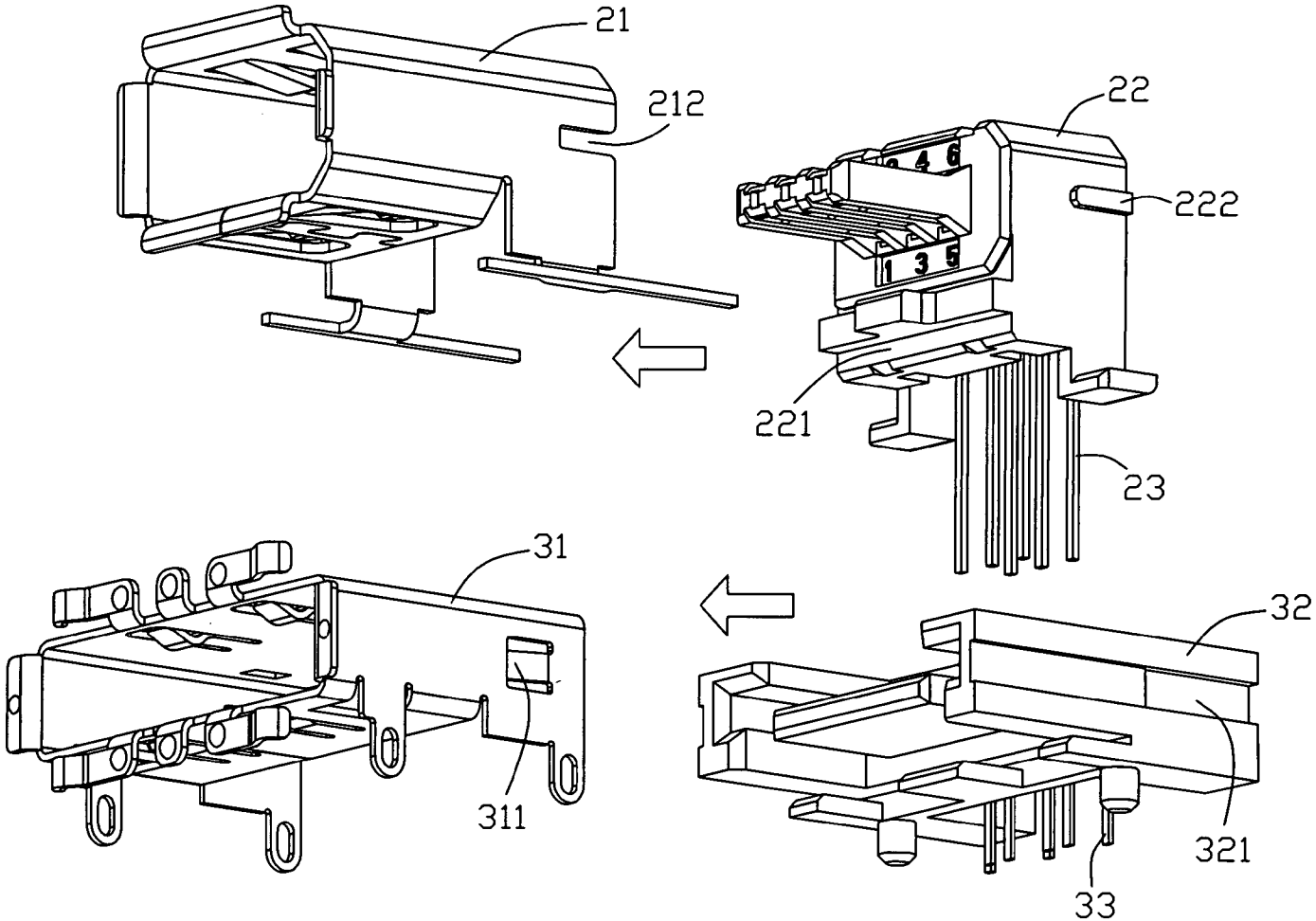
FIG. 3 is an exploded, perspective view of a stacked electrical connector assembly according to the present invention.
Figure 4:
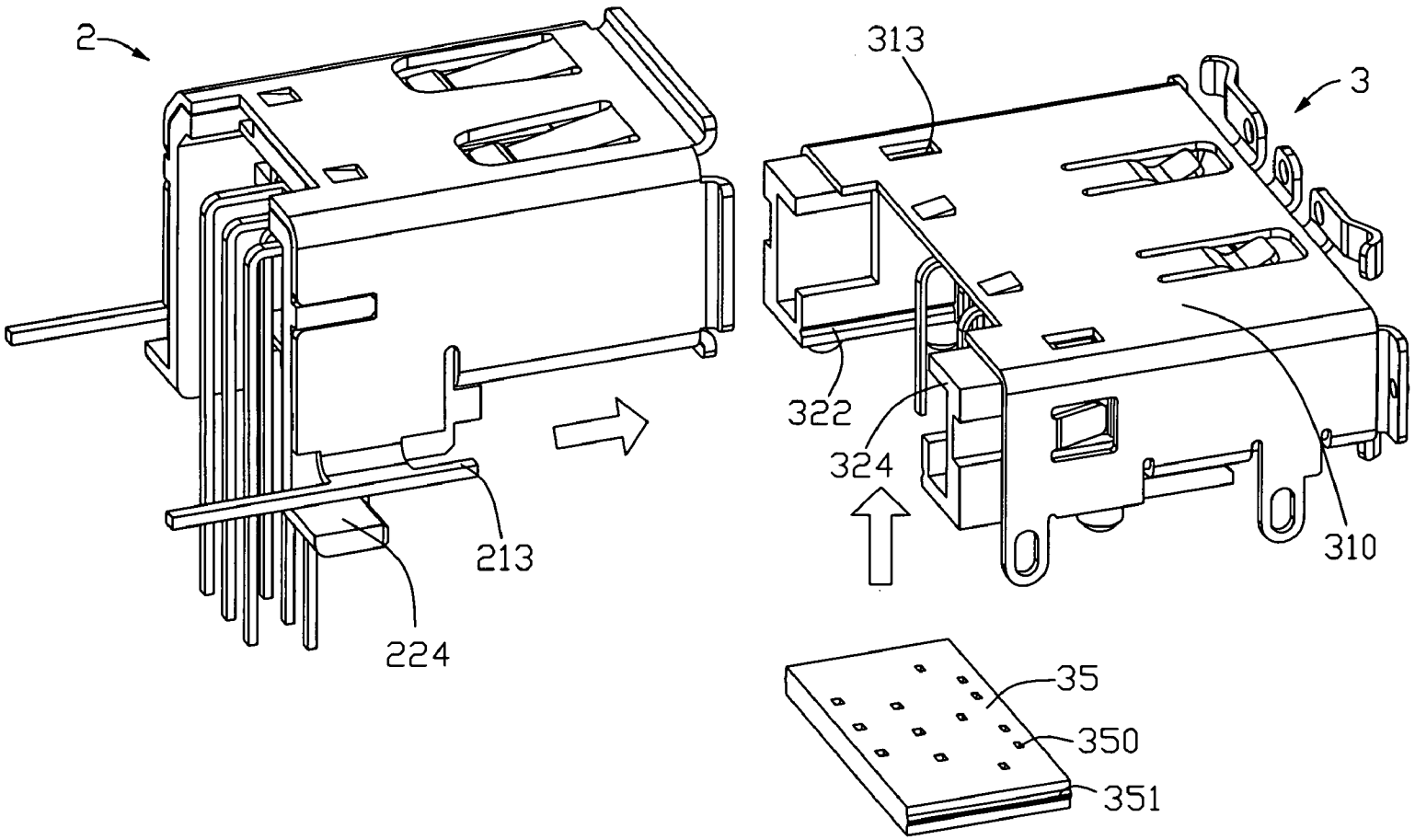
FIG. 4 is a partially exploded, perspective view of a stacked electrical connector assembly according to the present invention.

Referring to FIGS. 1-4, a stacked electrical connector assembly 1 according to the present invention is adapted for electrically connecting a complementary connector (not shown) and a print circuit board 9. The stacked electrical connector assembly 1 comprises a first electrical connector 2 (IEEE 1394 connector, Institute of Electrical and Electronics Engineers) and a second electrical connector 3. (Serial ATA connector, Serial Advanced Technology Attachment) vertically stacked with the first connector 1. In preferred embodiment, the second electrical connector 3 is located below the first electrical connector 2.

The first electrical connector 2 comprises a first metal shell 21, a first insulative housing 22 and a plurality of first terminals 23 received in the first insulative housing 22. The first metal shell 21 is stamped and bent from a metal sheet into a rectangular frame with a front opening 20 adapting for a complementary connector and a rear opening (not labeled) opposite to the front opening 20. The first insulative housing 22 defines a first tongue portion 220 accommodated in the first metal shell 21, a supporting portion 221 located at the bottom thereof, a pair of guiding ribs 222 located at two rear sides thereof, a pair of retaining holes 223 located on the top surface thereof and a pair of side limbs 224 located at two rear sides thereof and extending downwardly therefrom. The plurality of first terminal 23 symmetrically locates at the two opposite sides of the first tongue portion 220 with a plurality of tail portions (not labeled) extending through the rear opening and bent to electrically connecting with the print circuit board 9. The first metal shell 21 defines a pair of cutouts 212 respectively located at two rear sides thereof and engaging with the pair of guiding ribs 222 of the first insulative housing 22, respectively, a pair of elongated retaining portions 213 located at two rear and lower sides thereof and a pair of retaining tabs 211 located on the upper face thereof and engaging with the pair of retaining holes 223 of the first insulative housing 22 for preventing the first insulative housing 22 from escaping backwardly. In the preferred embodiment, the retaining portion 213 is a metal strip integrally formed with the first metal shell 21.

The second electrical connector 3 with a structure similar to the first electrical connector 2, comprises a second metal shell 31, a second insulative housing 32 and a plurality of second terminals 33 received in the second insulative housing 32. The second metal shell 31 is stamped and bent from a metal sheet into a rectangular frame with a front opening 30 adapting for a complementary connector (not shown) and a rear opening (not labeled) opposite to the front opening 30. The second insulative housing 32 defines a second tongue portion 320 accommodated in the second metal shell 31, a pair of stepped locking slots 321 located rear sides thereof, a pair of locking holes 323 located on upper surface thereof and a pair of inner projections 324 located at two rear sides thereof and extending toward each other. The plurality of second terminal 33 locates on the upper surface of the second tongue portion 320 with a plurality of tail portions (not labeled) extending through the rear opening and bent to electrically connecting with the print circuit board 9. The second metal shell 31 seat on the upper surface 90 of the print circuit board 9 and defines a pair of retaining stabs 311 at the two rear sides thereof, a pair of retaining feet 312 extending downwardly therefrom and respectively engaging with the mounting holes 91 and a pair of retaining slots 313 located at the rear side of the second metal shell 31.

In the preferred embodiment, the first electrical connector 2 is a standard IEEE 134 connector, and the second electrical connector 3 is a standard Serial ATA connector. Therefore, there is no need to describe the detailed specification of the first electrical connector 2 and the second electrical connector 3.

Referring to FIGS. 1-4, in assembly, the first insulative housing 22 with a plurality of first terminals 23 and the second insulative housing 32 with a plurality of second terminals 33 are respectively assemble with the first metal shell 21 and the second metal shell 31. The pair of cutouts 212 of the first metal shell 21 engage with the pair of guiding ribs 222 of the first insulative housing 22. The pair of retaining tabs 211 of the first metal shell 21 engage with the pair of retaining holes 223 of the first insulative housing 22 for preventing the first insulative housing 22 from escaping backwardly. The pair of retaining stabs 311 of the second shell 31 engage with the pair of stepped locking slots 321 of the second insulative housing 32 for preventing the second insulative housing 32 from escaping backwardly. Therefore, the first electrical connector 2 and the second electrical connector 3 are respectively assembled.

Then, the first electrical connector 2 is assembled with the second electrical connector 3 from the top of the second electrical connector 3 with the supporting portion 221 of the first insulative housing 22 resisting against the upper surface 310 of the second metal shell 31, the side limbs 224 of the first insulative housing 22 engaging with the inner projections 324 of the second insulative housing 32 for positioning and guiding function. And then, one side of the retaining portions 213 of the first metal shell 21 are respectively bent to lock with the pair of retaining slots 313 of the second metal shell 31 and the pair of locking holes 323 of the second insulative housing 32, and another side of the retaining portion 213 is bent to bind the first insulative housing 22 and the second insulative housing 32. In the preferred embodiment, a positioning plate 35 is employed to be assembled into the receiving channel 322 of the second insulative housing 32 with a plurality of positioning holes 350 defined thereon. The plurality of tail portions (not labeled) of the first terminals 23 and the second terminals 33 respectively pass through the positioning holes 350. Accordingly, the assembly of the stacked electrical connector 1 according to the present invention is completed.

In an alternative embodiment, the electrical connector 1 according to the present invention can be vertically or in a certain angle mounted on the print circuit board 9 under some condition. The supporting portion 221 of the first insulative housing 22 is also alternatively located on the second insulative housing 32.

It is to be understood, however, that even though numerous, characteristics and advantages of the present invention have been set fourth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. A stacked electrical connector assembly, comprising:

a first electrical connector comprising a first metal shell, a first insulative housing shielded in the first metal shell and a plurality of first terminals received in the first insulative housing;

a second electrical connector stacked with the first electrical connector and comprising a second metal shell, a second insulative housing shielded in the second metal shell and a plurality of second terminals received in the second insulative housing; and wherein the first metal shell defines at least a retaining portion, the second metal shell and second insulative housing respectively defines at least a retaining hole and at least a locking hole corresponding to the retaining hole, said retaining portion locks with the retaining hole and the locking hole.

2. The stacked electrical connector assembly as described in claim 1, wherein the retaining portion is a retaining strip integrally formed with the first metal shell.

3. The stacked electrical connector assembly as claimed in claim 2, wherein one side of the retaining portion is bent to lock with the retaining hole of the second metal shell and the locking hole of the second insulative housing and another side of the retaining portion is bent to bind the first insulative housing and the second insulative housing.

4. The stacked electrical connector assembly as claimed in claim 3, wherein the first insulative housing comprises a pair of side limbs at two rear sides thereof, the second insulative housing comprises a pair of inner projections at two rear sides thereof and extending toward each other, said the pair of side limbs engage with the pair of inner projections for guiding and positioning function.

5. The stacked electrical connector assembly as claimed in claim 4, wherein first insulative housing defines a supporting portion resists against an upper surface of the second metal shell.

6. A stacked connector assembly comprising: an upper connector defining an insulative upper housing with a plurality of upper contacts therein and enclosed in an upper metallic shield; a lower connector located under the upper connector and defining an insulative lower housing with a plurality of lower contacts therein and enclosed in a lower metallic shield; said upper connector and said lower connector being discrete from each other under a condition that the insulative upper housing of the upper connector and the insulative lower housing of the lower connector are separate from each other; and at least one of said upper shield and said lower shield including unitarily a fastening device extending toward and actively fastened to the other of said upper shield and said lower shield to fasten said discrete upper and lower connectors together; wherein said fastening device is originally, in an extended manner in a horizontal direction for assembling the upper connector and the lower connector along said horizontal direction and successively deformed to a final bent shape in a vertical direction to fasten the upper connector and the lower connector together only after the upper connector and the lower connector reach corresponding final positions with each other.

7. The stacked connector assembly as claimed in claim 6, wherein said fastening device further fastens to the corresponding insulative housing of said at least one of the upper shield and said lower shield.

8. The stacked connector assembly as claimed in claim 6, wherein said at least one of said upper shield and said lower shield is said upper shield.

9. The stacked connector assembly as claimed in claim 6, wherein each of the upper contacts has an upper tail extending down from a rear portion of the upper connector and located at a rear side of said lower connector, and each of the lower contacts has a lower tail extending down from a rear portion of the lower connector.

10. The stacked connector assembly as claimed in claim 6, wherein said upper connector is smaller than said lower connector.

11. The stacked connector assembly as claimed in claim 6, wherein said fastening device further fastens to the corresponding insulative housing of said other of said upper shield and said lower shield.

12. The stacked connector assembly as claimed in claim 11, wherein said fastening device further fastens to the corresponding insulative housing of said at least one of the upper shield and said lower shield.

13. The stacked connector assembly as claimed in claim 12, wherein said at least one of said upper shield and said lower shield cooperates with the corresponding insulative housing to tightly sandwich the other of said upper shield and said lower shield and the corresponding insulative housing of the other of said upper shield and said lower shield therebetween in a vertical direction around said fastening device.

14. A stacked connector assembly comprising:

an upper connector defining an upper insulative housing with a plurality of upper contacts therein and enclosed in an upper metallic shield which defines a horizontal direction;

a lower connector located under the upper connector and defining a lower insulative housing with a plurality of lower contacts therein and enclosed in a lower metallic shield which defines the same horizontal direction;

said upper connector and said lower connector being discrete form each other under condition that the insulative upper housing of the upper connector and the insulative lower housing of the lower connector are separate from each other; and one of said upper housing and said upper shield defining a portion located inside a section of one of said lower housing and said lower shield in a vertical direction for assuring retention between the upper connector and the lower connector in said vertical direction when assembled under condition that the upper connector is horizontally assembled to the lower connector in said horizontal direction; wherein a fastening device extends in said vertical direction and horizontally engages said portion for assuring retention between the upper connector and the lower connector in the horizontal direction.

15. The stacked connector assembly as claimed in claim 14, wherein said fastening device is unitarily formed with one of said upper shield and said lower shield, and extends toward the other of said upper shield and said lower shield.

16. The stacked connector assembly as claimed in claim 14, wherein said fastening device is originally in an extended manner in said horizontal direction for assembling the upper connector and the lower connector along said horizontal direction and successively deformed to a final bent shape in the vertical direction to fasten the upper connector and the lower connector together only after the upper connector and the lower connector reach corresponding final positions with each other.

17. The stacked connector assembly as claimed in claim 14, wherein said upper connector is smaller than said lower connector.

18. The stacked connector assembly as claimed in claim 14, wherein said one of the upper housing and said upper shield is the upper housing, and said one of the lower housing and the lower shield is the lower housing.

19. The stacked connector assembly as claimed in claim 18, wherein the lower housing defines a gap in an intermediate portion of a rear edge thereof, said portion of the upper housing is connected to the upper housing through said gap.

* * * * *